US012044007B2

(12) United States Patent
Wu

(10) Patent No.: US 12,044,007 B2
(45) Date of Patent: Jul. 23, 2024

(54) ADJUSTABLE GLASS MOUNTING GROOVE

(71) Applicant: Foshan YG Building Material Co., Ltd., Foshan (CN)

(72) Inventor: Fei Wu, Foshan (CN)

(73) Assignee: Foshan YG Building Material Co., Ltd., Foshan (CN)

( * ) Notice: Subject to any disclaimer, the term of this patent is extended or adjusted under 35 U.S.C. 154(b) by 218 days.

(21) Appl. No.: 17/640,596

(22) PCT Filed: May 7, 2020

(86) PCT No.: PCT/CN2020/088931
§ 371 (c)(1),
(2) Date: Mar. 4, 2022

(87) PCT Pub. No.: WO2021/103422
PCT Pub. Date: Jun. 3, 2021

(65) Prior Publication Data

US 2022/0333376 A1 Oct. 20, 2022

(30) Foreign Application Priority Data

Nov. 29, 2019 (CN) ..... 201911196953.9

(51) Int. Cl.
*E04B 2/82* (2006.01)
*E04B 2/88* (2006.01)
(Continued)

(52) U.S. Cl.
CPC ..... *E04B 2/82* (2013.01); *E04B 2/88* (2013.01); *E04F 11/1817* (2013.01); *E04B 2002/7461* (2013.01)

(58) Field of Classification Search
CPC ..... E04B 2/82; E04B 2/88; E04B 2002/7461; E04F 11/1817
(Continued)

(56) References Cited

U.S. PATENT DOCUMENTS 4,819,781 A * 4/1989 Saito ..... B66B 23/22 198/335
4,841,697 A * 6/1989 Hogg ..... E04F 11/1853 52/208
(Continued)

FOREIGN PATENT DOCUMENTS

CN 1099004 A 10/2000
CN 202627361 A 12/2012
(Continued)

OTHER PUBLICATIONS

International Search Report and Written Opinion of CN2019/111546, Mailed Mar. 26, 2020.

*Primary Examiner* — Brian E Glessner
*Assistant Examiner* — James J Buckle, Jr.
(74) *Attorney, Agent, or Firm* — Birchwood IP

(57) ABSTRACT

The present disclosure relates to an adjustable glass mounting groove, comprising a U-shaped groove body, a support block, a first screw and a first nut, wherein the U-shaped groove body includes a groove bottom, a left groove arm and a right groove arm, the support block includes a bottom support portion, a side support portion, and a matching portion in rotational connection with the first screw, the first nut is fixed in the U-shaped groove body, the first screw is in rotational connection with the support block, and the support block is slidingly fitted with the U-shaped groove body along the movement direction of the first screw. The present disclosure is provided with a functional component for fine-tuning the installation depth and angle of the glass, reducing the risk of glass damage and saving labor, the overall structure is reasonable and stable.

8 Claims, 4 Drawing Sheets

(51) Int. Cl.
*E04F 11/18* (2006.01)
*E04B 2/74* (2006.01)

(58) Field of Classification Search
USPC ..... 52/126.4
See application file for complete search history.

(56) References Cited

U.S. PATENT DOCUMENTS

| | | | | |
|---|---|---|---|---|
| 7,559,536 | B1 * | 7/2009 | Hansen | E04F 11/1851 256/25 |
| 7,866,636 | B1 * | 1/2011 | Hansen | E04F 11/1851 256/65.14 |
| 8,820,721 | B1 * | 9/2014 | Poma | E04H 9/14 256/65.14 |
| 9,127,474 | B2 * | 9/2015 | Tinwala | E04F 11/1853 |
| 9,945,511 | B2 * | 4/2018 | Mitrovic | F16M 13/02 |
| 10,669,770 | B1 * | 6/2020 | Pittella | E06B 3/06 |
| 10,934,743 | B2 * | 3/2021 | Sprague | F16J 15/025 |
| 11,085,193 | B2 * | 8/2021 | Cataldi | E04F 19/061 |
| 2016/0298337 | A1 | 10/2016 | Header | |
| 2019/0177973 | A1 * | 6/2019 | Mitrovic | E04H 4/14 |
| 2022/0127856 | A1 * | 4/2022 | Chapel | E04F 11/1812 |

FOREIGN PATENT DOCUMENTS

| | | | |
|---|---|---|---|
| CN | 103850411 | A | 6/2014 |
| CN | 105003037 | A | 10/2015 |
| CN | 205531090 | U | 8/2016 |
| CN | 209099668 | U | 7/2019 |
| CN | 110656741 | A | 1/2020 |

* cited by examiner

ADJUSTABLE GLASS MOUNTING GROOVE

CROSS-REFERENCE TO RELATED APPLICATIONS

This is a continuation of International Application PCT/CN2020/088931, with an international filing date of May 7, 2020, which claims foreign priority of Chinese Patent Application No. 201911196953.9, filed on Nov. 29, 2019 in the State Intellectual Property Office of China, the contents of all of which are hereby incorporated by reference.

TECHNICAL FIELD

The present disclosure relates to the technical filed of glass profiles, and in particular to an adjustable glass mounting groove.

BACKGROUND

In daily buildings, it is very common to use glass as structures such as railings, partition walls or curtain walls. When installing such glass products, glass buckles and glass mounting grooves are usually used for fixing. For example, glass railings are usually installed with glass mounting grooves on the left and right or upper and lower sides, or the glass is directly embedded in the glass mounting grooves on both sides. However, the structure of the existing glass buckles and glass mounting grooves are relatively simple, and can only be fastened to the glass, but for some installations with large curvatures, large arcs or uneven ground, the height of the glass installation is not uniform and the angle is skewed, and it may not be possible to ensure that the glass buckles or glass mounting grooves on both sides are facing each other. There may be a positional deviation with a small angle, or there may be an error in the size of the glass cutting. In these cases, it will be much more difficult to install the glass. Even if it is installed reluctantly, it will bring about the problem of uneven local stress on the glass.

SUMMARY

The purpose of the present disclosure is to overcome the defect that the existing glass mounting groove fails to properly fine-tune the glass position according to the actual installation scene.

In order to achieve the above purpose, the present disclosure provides an adjustable glass mounting groove including a U-shaped groove body, a support block, a first screw and a first nut, the U-shaped groove body including a groove bottom, a left groove arm and a right groove arm on both side of the groove bottom, the support block including a bottom support portion for carrying a bottom of a glass, a side support portion for carrying a side of the glass and a matching portion for rotational connecting with the first screw, the first nut is fixed within the U-shaped groove body, the first screw is rotational connected with the support block, the first screw and the first nut thread fit, the support block is slidingly matched with the U-shaped groove body(1) along the moving direction of the first screw.

As a preference, the groove bottom is provided with a buffer arm protruding from the groove bottom, the buffer arm forms a regulating chamber with the right groove arm, the buffer arm forms a housing chamber with the left groove arm, the first nut is fixed within the regulating chamber.

Further, the bottom support portion is located on one side of the side support portion, the matching portion is located on the other side of the side support portion, the side support portion is composed of a side support arm and a side support bottom respectively located on the upper edge and the lower edge, the bottom support portion is located at the bottom end of the side support portion to form an "L"-shaped structure, the side support bottom and the bottom support portion are movably arranged in the housing chamber, and the matching portion is connected between the side support arm and the side support bottom.

Further, the side support arm is provided with a locking screw, the locking screw pierces the side support arm from the side of the matching portion to the side of the bottom support portion.

As a preference, the connection of the first screw and the support block is ground off the thread, and the first screw is provided with a blocking block for preventing the sliding of the support block.

As a preference, the adjustable glass mounting groove includes a first angular adjustment assembly, the first angular adjustment assembly is arranged on the inner side of the right groove arm (13), and squeeze towards the left groove arm.

Further, the first angular adjustment assembly comprises a glass pressing sheets, a second screw and a second nut, the second nut is fixed on the inner side of the right groove arm, the second screw and the second nut are threaded in a direction perpendicular to the right groove arm, and the side of the second screw away from the second nut is rotatably connected with the glass pressing sheet.

Further, the first angular adjustment assembly comprises a third screw, a first trapezoidal wedge and two first triangular wedges, the first triangular wedges are respectively located on the two hypotenuse sides of the first trapezoidal wedge to form a rectangular parallelepiped structure, and the third screw passes through the first trapezoidal wedge and the two first triangular wedge, and is screwed together with the two first triangular wedges at the same time, wherein the first triangular wedges located on the bottom side of the first trapezoidal wedge are fixed connection with the right groove arm, the connection between the first trapezoidal wedge and the third screw is a cavity structure whose horizontal width is greater than the outer diameter of the third screw, and the first trapezoidal wedge follows the third screw screwed in or out to slidingly fit with the first triangular wedge in the horizontal direction.

Further, the inner side of the left groove arm is provided with an elastic pad for forming a reaction force.

As a preference, the adjustable glass mounting groove comprises a second angular adjustment assembly, the second angular adjustment assembly comprises a fourth screw, a second trapezoidal wedge and two second triangular wedges, the second triangular wedges are respectively located on the two hypotenuse sides of the second trapezoidal wedges to form a rectangular parallelepiped structure, the fourth screw passes through the second trapezoidal wedge and the two second triangular wedges, and is screwed together with the two second triangular wedges at the same time, wherein the second triangular wedges located on the bottom side of the second trapezoidal wedge are fixedly connected to the left groove arm, and the connection of the second trapezoidal wedge and the fourth screw is a cavity structure whose horizontal width is greater than the outer diameter of the fourth screw, and the second trapezoidal wedge follows the fourth screw screwed in or out to slidingly fit with the second triangular wedge in the horizontal direction.

The benefit effects of the present disclosure are: the functional components for fine-tuning the installation depth and installation angle of the glass are set up, which can flexibly adapt to the installation occasions with height deviation and angle deviation from the actual situation of the glass, reduce the risk of damage to the glass during the installation process, save labor, and the overall structure is reasonable and stable.

DETAILED DESCRIPTION

Figure 1:
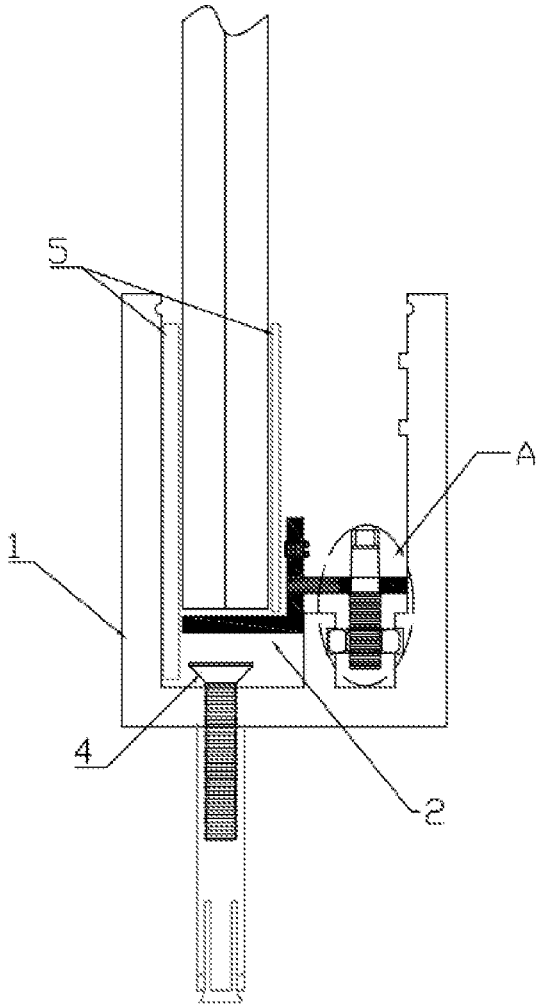
FIG. 1: a cross-sectional schematic diagram of the use state of the adjustable glass mounting groove according to an embodiment one.
Figure 2:
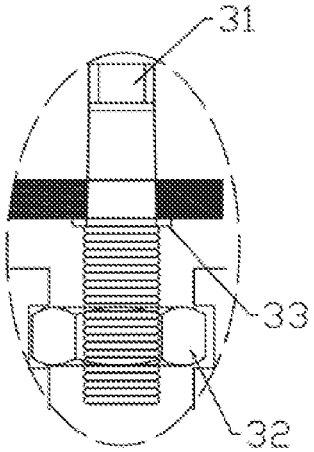
FIG. 2: an enlarged schematic diagram at A place in FIG. 1.
Figure 3:
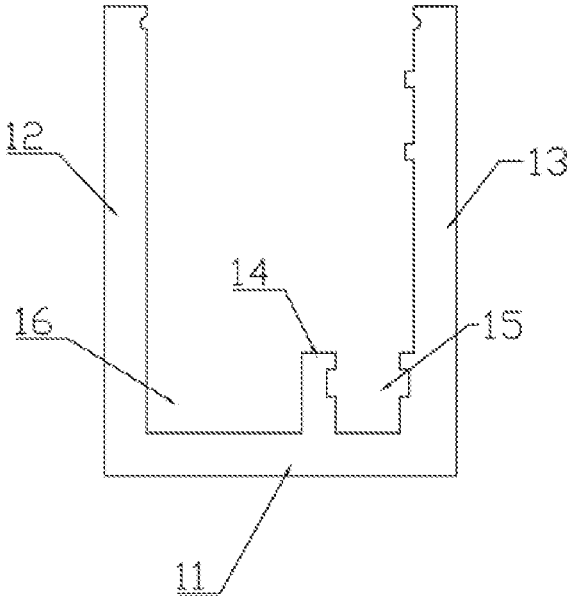
FIG. 3: a cross-sectional schematic diagram of U-shaped groove body according to the embodiment one.
Figure 4:
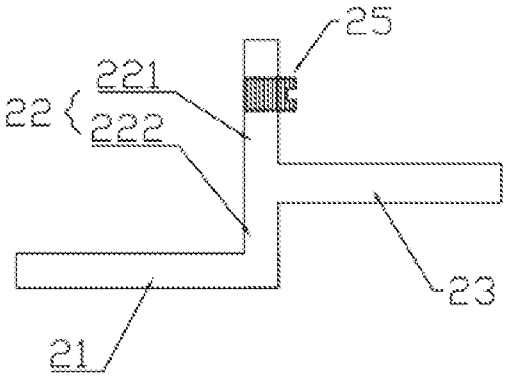
FIG. 4: a cross-sectional schematic diagram of the support block according to the embodiment one.

In order to make the objectives, technical solutions and advantages of the embodiments of the present disclosure clearer, the present disclosure will be further described below with reference to the embodiments and the accompanying drawings.

It should be noted that, in this document, relational terms such as "first", "second", "third" and "fourth" are only used to distinguish one entity or operation from another entity or operation, does not necessarily require or imply any such actual relationship or order between these entities or operations.

Embodiment One

Please refer to FIGS. 1-4, this embodiment provides an adjustable glass mounting groove, includes a U-shaped groove body 1, a support block 2, a first screw rod 31 and a first nut 32, and the support block 2, the first screw rod 31 and the first nut 32 are all located in the U-shaped groove body 1.

The U-shaped groove body 1 includes a groove bottom 11 and a left groove arm 12 and a right groove arm 13 respectively located on both sides of the groove bottom 11, wherein the groove bottom 11 is provided with a buffer arm 14 protruding from the groove bottom 11, the buffer arm 14 and the right slot arm 13 forms an regulating chamber 15, the buffer arm 14 and the left slot arm 12 form an housing chamber 16, the first nut 32 is fixed in the regulating chamber 15, specifically the first nut 32 is embedded in the buffer arm 14 and the right groove arm 13, there is a certain distance between the first nut 32 and the bottom of the regulating chamber 15, and a fixing screw 4 for fixing the U-shaped groove body 1 is installed on the groove bottom 11.

The supporting block 2 includes a bottom support portion 21 for carrying the bottom of the glass, a side support portion 22 for carrying the side of the glass, and a matching portion 23 for rotational connecting with the first screw 31. The bottom support portion 21 is located on one side of the side support portion 22, and the matching portion 23 is located on the other side of the side support portion 22; wherein, the side support portion 22 consists of a side support arm 221 and a side support bottom 222 respectively located on the upper edge and the lower edge. The bottom support portion 21 is located at the bottom end of the side support bottom 222 to form an "L"-shaped structure, the side support bottom 222 and the bottom support portion 21 are movably arranged in the housing chamber 16, and the matching portion 23 is connected to the side support arm 221 and the side support bottom 222.

In this embodiment, the first screw 31 is rotatably connected with the support block 2, and the first screw 31 and the first nut 32 are threadedly matched, so that the support block 2 is slidably matched with the U-shaped groove body 1 along the moving direction of the first nut 32, so as to adjust the distance between the support block 2 and the groove bottom 11; specifically, the edge of the glass is installed in the cavity formed between the bottom support portion 21, the side support portion 22 and the left groove arm 12, by rotating the first screw 31 thereby, the relative position between the first screw 31 and the first nut 32 is adjusted, so that the first screw 31 rises or falls along the length of the glass, the connection between the first screw 31 and the support block 2 is ground off, and the first screw 31 is provided with a blocking block 33 for preventing the sliding of the support block 2, so that when the first screw 31 rotates, the support block 2 does not shift to the tail of the first screw 31 with the thread, but follows the first screw 31 rises or falls, so as to achieve the effect of adjusting the installation depth of the glass, which is suitable for the case where the length of the installation scene is slightly larger than the length of the glass.

In addition, in order to stably install the glass, the side support arm 221 is provided with a locking screw 25. The locking screw 25 pierces the side support arm 221 from the side of the matching portion 23 to the side of the bottom support portion 21. After installing the glass, tighten the locking screw 25, to stabilize the installation structure; and in order to prevent the glass installation from being scratched, an elastic pad 5 is provided at the glass installation.

Embodiment Two

Figure 5:
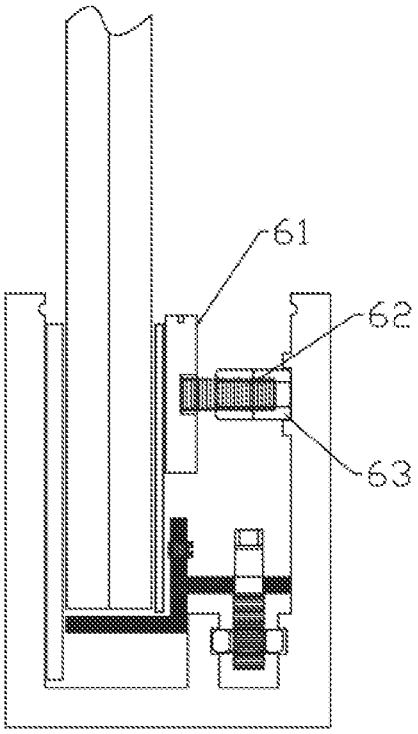
FIG. 5: a cross-sectional schematic diagram of the use state of the adjustable glass mounting groove according to an embodiment two.

Referring to FIG. 5, on the basis of the embodiment one, the adjustable glass mounting groove provided in this embodiment further includes a first angular adjustment assembly for fine-tuning the deflection angle of the glass, and the first angular adjustment assembly is arranged on the inner side of the right groove arm 13, and squeeze towards the left groove arm 12.

Technically, the first angular adjustment assembly comprises a glass pressing sheets 61, a second screw 62 and a second nut 63, the second nut 63 is fixed on the inner side of the right groove arm 13, the second screw 62 and the second nut 63 are threaded in a direction perpendicular to the right groove arm 13, and the side of the second screw 62 away from the second nut 63 is rotatably connected with the glass pressing sheet 61. By adjusting the position between the second screw 62 and the second nut 63, the glass pressing sheet 61 is moved toward the left groove arm 12 or retracted toward the right groove arm 13, so that the installation angle of the glass can be adjusted.

It should be noted that the first angular adjustment assembly is suitable for the installation scene, and there is a certain angular offset, which needs to be adapted by fine-tuning the glass angle. Adjusting the installation angle of the glass requires the glass mounting grooves on the opposite sides of the glass to be coordinated at the same time. During installation, the second screw 62 of the glass mounting groove on one side is tightened in the direction of the left groove arm 12, and the second screw 62 of the glass mounting groove on one side is properly retracted to the right groove arm 13 within the resilient range of the elastic pad 5, so that coordinate both sides; the side glass mounting groove adjusted to the right groove arm 13, because the elastic pad 5 has a certain rebound deformation, to ensure the stability of the glass installation, when the adjustment angle is large, a thicker elastic pad 5 can be used.

Embodiment Three

Figure 6:
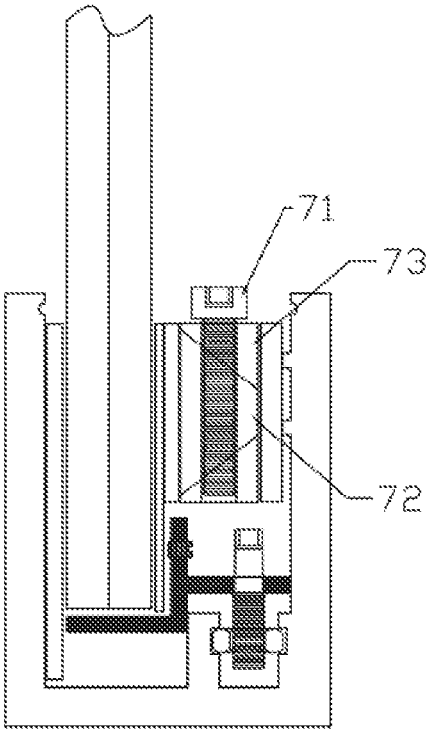
FIG. 6: a cross-sectional schematic diagram of the use state of the adjustable glass mounting groove according to an embodiment three.
Figure 7:
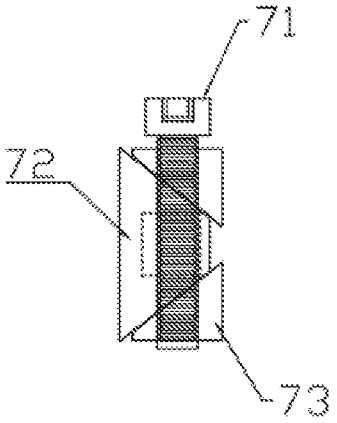
FIG. 7: a cross-sectional schematic diagram of the first angular adjustment assembly according to the embodiment three.

Referring to FIG. 6-7, on the basis of the embodiment one, this embodiment provides another first angular adjustment assembly including a third screw 71, a first trapezoidal wedge 72 and two first triangular wedges 73, the first triangular wedges 73 are respectively located on the two hypotenuse sides of the first trapezoidal wedge 72 to form a rectangular parallelepiped structure, and the third screw 71 passes through the first trapezoidal wedge 72 and the two first triangular wedge 73, and is screwed together with the two first triangular wedges 73 at the same time, wherein the first triangular wedges 73 located on the bottom side of the first trapezoidal wedge 72 are fixed connection with the right groove arm 13, the connection between the first trapezoidal wedge 72 and the third screw 71 is a cavity structure whose horizontal width is greater than the outer diameter of the third screw 71, and the first trapezoidal wedge 72 follows the third screw 71 screwed in or out to slidingly fit with the first triangular wedge 73 in the horizontal direction.

In this embodiment, the adjustment requirements of larger angles can be accommodated. The first triangular wedge 73 is threadedly matched with the third screw 71. The first trapezoidal wedge 72 has a cavity structure and is located between the two first triangular wedges 73. When the third screw 71 goes deep into the first triangular wedge 73, the first trapezoidal wedge 72 is pushed out along the inclined plane, and pushes the glass to the direction of the left groove arm 12, otherwise, the glass can be adjusted to the direction of the right groove arm 13.

Embodiment Four

Figure 8:
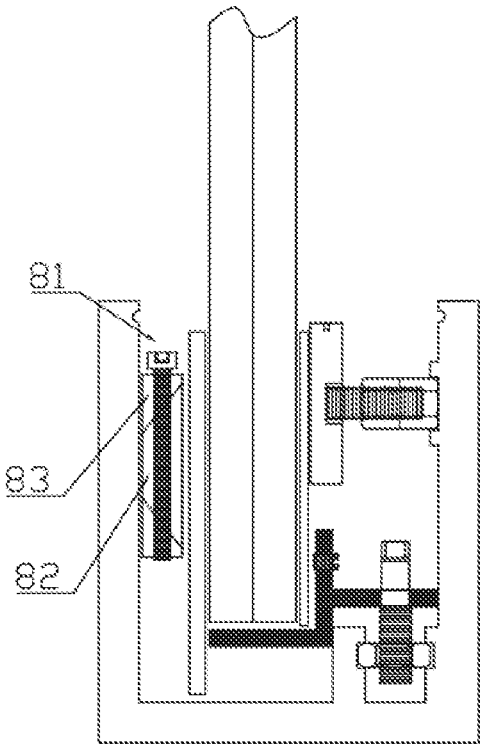
FIG. 8: a cross-sectional schematic diagram of the use state of the adjustable glass mounting groove according to an embodiment four.

Referring to FIG. 8, on the basis of the embodiment one, in combination with the embodiment two and the embodiment three, the adjustable glass mounting groove provided in this embodiment further includes a second angular adjustment assembly, the second angular adjustment assembly comprises a fourth screw 81, a second trapezoidal wedge 82 and two second triangular wedges 83, the second triangular wedges 83 are respectively located on the two hypotenuse sides of the second trapezoidal wedges 82 to form a rectangular parallelepiped structure, the fourth screw 81 passes through the second trapezoidal wedge 82 and the two second triangular wedges 83, and is screwed together with the two second triangular wedges 83 at the same time, wherein the second triangular wedges 83 located on the bottom side of the second trapezoidal wedge 82 are fixedly connected to the left groove arm 12, and the connection of the second trapezoidal wedge 82 and the fourth screw 81 is a cavity structure whose horizontal width is greater than the outer diameter of the fourth screw 81, and the second trapezoidal wedge 82 follows the fourth screw 81 screwed in or out to slidingly fit with the second triangular wedge 83 in the horizontal direction.

In this embodiment, the first angular adjustment assembly and the second angular adjustment assembly are respectively located on both sides of the glass, wherein the second angular adjustment assembly replaces the elastic pad 5 (for protecting the glass surface, which is still used to set the elastic pad), after determining the angle of the adjustment glass, first loosen the adjustment assembly on one side, and then adjust the adjustment assembly on the other side to tighten, which has higher installation stability.

Compared with the prior art, the adjustable glass mounting groove provided by the present disclosure is provided with functional components for fine-tuning the installation depth and installation angle of the glass, which can adapt to installation occasions with height deviation and angle deviation from the actual situation of the glass, and the structure is reasonable and stable, with significant progress.

The above descriptions are only the preferred embodiments of the present disclosure, and are not intended to limit the present disclosure. Although the present invention has been described in detail with reference to the foregoing embodiments, those skilled in the art can still understand what the foregoing embodiments are. The recorded technical solutions are modified, or some technical features thereof are equivalently replaced. Any modification, equivalent replacement, improvement, etc. made within the spirit and principle of the present invention shall be included within the protection scope of the present disclosure.

What is claimed is:

1. An adjustable glass mounting groove, comprising: a U-shaped groove body (1), a support block (2), a first screw (31), a first nut (32) and a first angular adjustment assembly, the U-shaped groove body (1) comprising a groove bottom (11), a left groove arm (12) and a right groove arm (13) on both side of the groove bottom (11), the first angular adjustment assembly is arranged on the inner side of the right groove arm (13), and squeeze towards the left groove arm (12), the support block (2) comprises a bottom support portion (21) for carrying a bottom of a glass, a side support portion (22) for carrying a side of the glass and a matching portion (23) for rotational connecting with the first screw (31), the first nut (32) is fixed within the U-shaped groove body (1), the first screw (31) is rotational connected with the support block (2), the first screw (31) and the first nut (32) thread fit, the connection of the first screw (31) and the support block (2) is ground off the thread, and the first screw (31) is provided with a blocking block (33) for preventing the sliding of the support block (2), the support block (2) is slidingly matched with the U-shaped groove body (1) along the moving direction of the first screw (31); wherein the first angular adjustment assembly comprises a glass pressing sheets (61), a second screw (62) and a second nut (63), the second nut (63) is fixed on the inner side of the right groove arm (13), the second screw (62) and the second nut (63) are threaded in a direction perpendicular to the right groove arm (13), and the side of the second screw (62) away from the second nut (63) is rotatably connected with the glass pressing sheet (61).

2. The adjustable glass mounting groove according to claim 1, wherein the groove bottom (11) is provided with a buffer arm (14) protruding from the groove bottom, the buffer arm (14) forms a regulating chamber (15) with the right groove arm (13), the buffer arm (14) forms a housing chamber (16) with the left groove arm (12), the first nut (32) is fixed within the regulating chamber (15).

3. The adjustable glass mounting groove according to claim 2, wherein the bottom support portion (21) is located on one side of the side support portion (22), the matching portion (23) is located on the other side of the side support portion (22), the side support portion (22) is composed of a side support arm (221) and a side support bottom (222) respectively located on the upper edge and the lower edge, the bottom support portion (21) is located at the bottom end of the side support portion (22) to form an "L"-shaped structure, the side support bottom (222) and the bottom support portion (21) are movably arranged in the housing chamber (16), and the matching portion (23) is connected between the side support arm (221) and the side support bottom (222).

4. The adjustable glass mounting groove according to claim 3, wherein the side support arm (221) is provided with a locking screw (25), the locking screw (25) pierces the side support arm (221) from the side of the matching portion (23) to the side of the bottom support portion (21).

5. The adjustable glass mounting groove according to claim 1, wherein the first angular adjustment assembly comprises a third screw (71), a first trapezoidal wedge (72) and two first triangular wedges (73), the first triangular wedges (73) are respectively located on the two hypotenuse sides of the first trapezoidal wedge (72) to form a rectangular parallelepiped structure, and the third screw (71) passes through the first trapezoidal wedge (72) and the two first triangular wedge (73), and is screwed together with the two first triangular wedges (73) at the same time, wherein the first triangular wedges (73) located on the bottom side of the first trapezoidal wedge (72) are fixed connection with the right groove arm (13), the connection between the first trapezoidal wedge (72) and the third screw (71) is a cavity structure whose horizontal width is greater than the outer diameter of the third screw (71), and the first trapezoidal wedge (72) follows the third screw (71) screwed in or out to slidingly fit with the first triangular wedge (73) in the horizontal direction.

6. The adjustable glass mounting groove according to claim 5, wherein the inner side of the left groove arm (12) is provided with an elastic pad (5) for forming a reaction force.

7. The adjustable glass mounting groove according to claim 6, wherein the inner side of the left groove arm (12) is provided with an elastic pad (5) for forming a reaction force.

8. The adjustable glass mounting groove according to claim 1, wherein the adjustable glass mounting groove comprises a second angular adjustment assembly, the second angular adjustment assembly comprises a fourth screw (81), a second trapezoidal wedge (82) and two second triangular wedges (83), the second triangular wedges (83) are respectively located on the two hypotenuse sides of the second trapezoidal wedges (82) to form a rectangular parallelepiped structure, the fourth screw (81) passes through the second trapezoidal wedge (82) and the two second triangular wedges (83), and is screwed together with the two second triangular wedges (83) at the same time, wherein the second triangular wedges (83) located on the bottom side of the second trapezoidal wedge (82) are fixedly connected to the left groove arm (12), and the connection of the second trapezoidal wedge (82) and the fourth screw (81) is a cavity structure whose horizontal width is greater than the outer diameter of the fourth screw (81), and the second trapezoidal wedge (82) follows the fourth screw (81) screwed in or out to slidingly fit with the second triangular wedge (83) in the horizontal direction.

* * * * *